United States Patent [19]

Buermann, Jr. et al.

[11] Patent Number: 4,833,875

[45] Date of Patent: May 30, 1989

[54] ROLLER CHAIN ASSEMBLING DEVICE

[76] Inventors: Henry Buermann, Jr., RR #1, Box 151, Brookfield, Vt. 05036; Alvin W. Day, Box 651, Main St., Williamstown, Vt. 05679

[21] Appl. No.: 117,498

[22] Filed: Nov. 6, 1987

[51] Int. Cl.[4] ..... B21L 21/00

[52] U.S. Cl. ..... 59/7; 72/454; 29/525; 29/251

[58] Field of Search ..... 29/505, 517, 525, 718, 29/251; 59/4, 7, 8, 35.1; 72/454

[56] References Cited

U.S. PATENT DOCUMENTS

| | | | |
|---|---|---|---|
| 1,436,429 | 11/1922 | Bean | 59/7 |
| 2,361,971 | 11/1944 | Shipman | 59/7 |
| 2,744,429 | 5/1956 | Seely | 72/390 |
| 2,917,893 | 12/1959 | Kausche | 59/7 |
| 3,553,960 | 1/1971 | Ellefson | 59/7 |
| 4,084,369 | 4/1978 | Luebbers | 59/7 |
| 4,459,839 | 7/1984 | Cochran et al. | 72/454 |
| 4,635,437 | 1/1987 | Parton | 72/454 |

*Primary Examiner*—David Jones

*Attorney, Agent, or Firm*—Fleit, Jacobson, Cohn & Price

[57] ABSTRACT

An assembling device including a tool to assemble a master link with the ends of a roller chain to form a continuous roller chain such as the drive chain utilized to drive a motorcycle. The device resembles a vise structure and includes a stationary plate or anvil with recesses receiving the headed end of the pins on a master link and a movable plate having a surface engaging a side plate to be press fitted onto the free ends of the pins of the master link with the movable plate including apertures into which the free ends of the pins may extend when the side plate is press fitted onto the pins inwardly of the grooves provided in the free end portions of the pins which normally receive a locking device. The side plate is assembled onto the free ends of the pins with an evenly distributed force while maintaining the side plate in precise perpendicular relation to the pins so as not to deform the master link and thereby negate the positive structural aspects of the side plate being press fitted onto the pins of the master link. The movable plate is actuated by a screw threaded member and is spring biased toward a retracted position.

3 Claims, 1 Drawing Sheet

ROLLER CHAIN ASSEMBLING DEVICE

BACKGROUND OF THE INVENTION

Field of the Invention

The present invention generally relates to a roller chain assembling device and more specifically a tool to assemble a master link with the ends of a roller chain to form a continuous roller chain such as the drive chain utilized to drive a motorcycle. The device resembles a vise structure and includes a stationary plate or anvil with recesses receiving the headed end of the pins on a master link and a movable plate having a surface engaging a side plate to be press fitted onto the free ends of the pins of the master link with the movable plate including apertures into which the free ends of the pins may extend when the side plate is press fitted onto the pins inwardly of the grooves provided in the free end portions of the pins which normally receive a locking device. The side plate is assembled onto the free ends of the pins with an evenly distributed force while maintaining the side plate in precise perpendicular relation to the pins so as not to deform the master link and thereby negate the positive structural aspects of the side plate being press fitted onto the pins of the master link. The movable plate is actuated by a screw threaded member and is spring biased toward a retracted position.

INFORMATION DISCLOSURE STATEMENT

The disassembly and assembly of drive chains of various types has been an ongoing problem and various tools have been developed for this purpose. Roller chains such as those utilized as drive chains in various types of vehicles including bicycles, motorcycles and the like frequently utilize a master link that includes a side plate loosely received on the free ends of a pair of pins extending through end rollers from a side plate at the opposite side of the chain with the assembled side plate being held in place by a spring device associated with the grooved ends of the pins. This type of structure was easy to assemble but it has now become conventional for the assembled side plate to be press fitted onto the pins which provides a more effective chain link which is especially desirable in motorcycle drive chains. There are no assembly devices available to assemble the master link into a roller drive chain when the master link includes a press-fitted side plate assembled onto the pins of the master link after the master link has been assembled with respect to the rollers on the ends of a roller drive chain.

SUMMARY OF THE INVENTION

An object of the present invention is to provide a device for assembling a master link into a roller drive chain for connecting the ends of a drive chain to form a continuous drive chain with the assembling device constructed in a manner to assemble a side plate onto the pins of a master link when the side plate has a press-fit relationship to the pins.

Another object of the invention is to provide a roller chain assembling device in accordance with the preceding object in the form of a base plate having a stationary plate mounted at each end thereof and extending in perpendicular relation to the base plate and in parallel relation to each other together with a movable plate disposed in perpendicular relation to the base plate and in parallel relation to the end plates for movement toward and away from the end plates with the movable plate being moved in response to a threaded member that extends through one of the end plates with the movable plate including apertures for alignment with the grooved free ends of the pins on a master link in order to engage the side plate to be assembled onto the pins of the master link and force the side plate into press-fitted relationship to the pins with the movable plate being maintained in accurate relationship to the pins for maintaining the assembled side plate in proper alignment and in proper relationship to the pins during assembly thereby preventing the side plate from becoming misaligned or tilted so that the press-fit relationship between the side plate and pins will be properly maintained during assembly thereby maintaining the advantages to be derived from the press fit of the side plate onto the pins.

A further object of the invention is to provide a roller chain master link assembling device especially adapted to connect the ends of roller chains to form a continuous chain and which is relatively simple in construction, easy to use and effective for forcing a side plate of a master link onto the pins of the master link when the side plate is provided with a press-fitted relationship with the master link pins.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
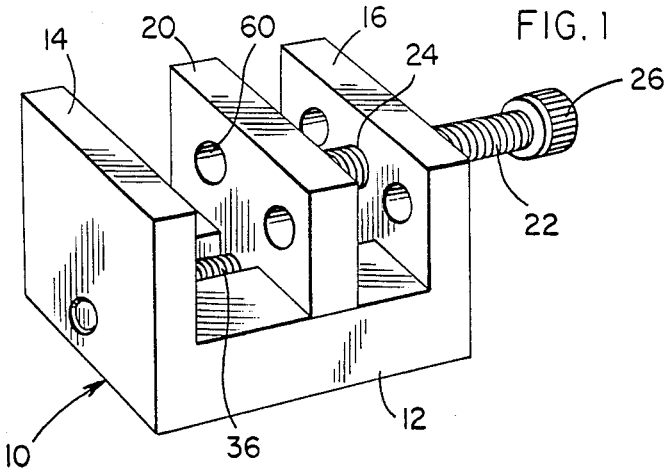
FIG. 1 is a perspective view of the roller chain assembling device of the present invention.
Figure 3:
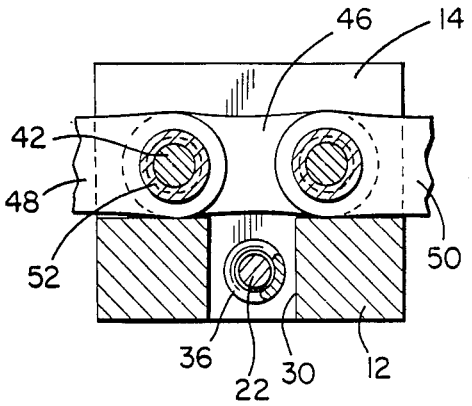
FIG. 3 is a sectional view taken substantially upon a plane passing along section line 3—3 on FIG. 2 illustrating further structural details of the invention.
Figure 2:
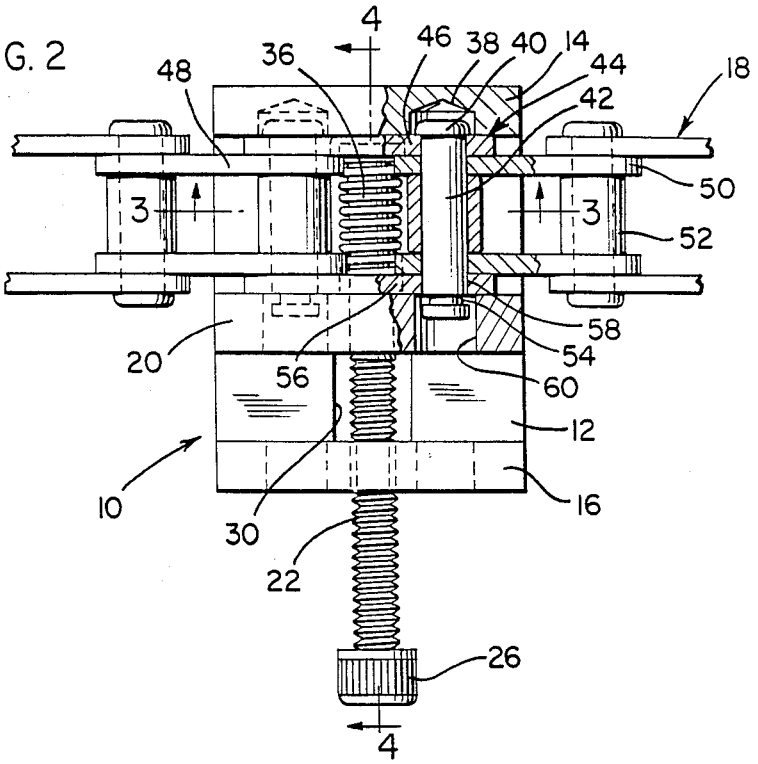
FIG. 2 is a top plan view of the assembling device illustrating its association with a master link of a roller chain illustrating the association of the assembling device with the roller chain and master link.
Figure 4:
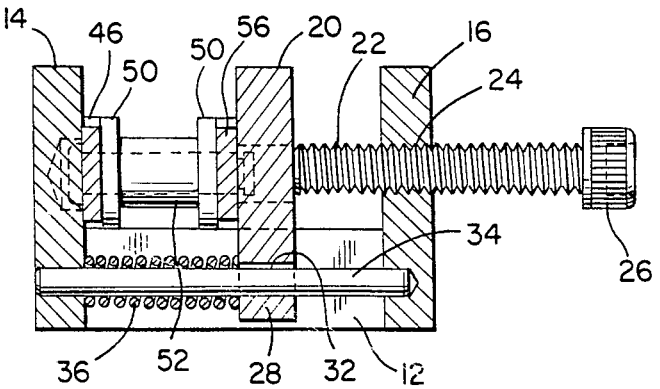
FIG. 4 is a transverse sectional view taken substantially upon a plane passing along section line 4—4 on FIG. 2 illustrating further structural details of the invention.

Referring now specifically to the drawings, the roller chain assembling device of the present invention is generally designated by reference numeral 10 and has a configuration generally in the form of a vise and which includes a base plate 12 having stationary end plates 14 and 16 extending from the ends of the base plate 12 in perpendicular relation to the base plate and in parallel relation to each other. The base plate and end plates may be of unitary construction or the end plates may be rigidly affixed to the end edges of the base plate 12 in any suitable manner. Thus, the base plate and end plates form a generally U-shaped structure in which the height of the end plates is such as to receive a roller chain generally designated by numeral 18 therein so that the roller chain is oriented below the upper edge of the end plates 14 and 16 as illustrated in FIGS. 3 and 4.

Positioned between the end plates 14 and 16 is a movable plate 20 perpendicular to the base plate 12 and parallel to the end plates 14 and 16 with the movable plate 20 being moved laterally between the end plates 14 and 16 by a screw threaded member 22 that is threaded through an aperture 24 in the end plate 16 and is provided with a knurled head 26 at its outer end which includes an internal socket for receiving a wrench to enable rotation of the threaded member 22. The inner end of the threaded member 22 engages the movable plate 20 to move it toward the end plate 14 into clamping engagement with the roller chain 18 in a manner described in more detail hereinafter.

The movable plate 20 includes a depending lug 28 that is not closely received in a longitudinal slot or groove 30 formed in the base plate 12. The depending lug 28 is provided with an aperture 32 which slidably receives a guide rod 34 extending longitudinally in the slot 30. The rod 34 is rigid and is rigidly mounted in the ends of the slot to provide a precise guide for the movable plate 20 and prevent it from canting and rocking and to maintain it in alignment with and parallel to plates 14 and 16. The rod 34 has a close fit in the aperture 32 to maintain side-to-side and top-to-bottom parallelism of the movable plate 20 with respect to the end plates 14 and 16. A spring 36 encircles the guide pin 34 between the end plate 14 and the lug 28 thus biasing the movable plate away from the end plate 14 and biasing the movable plate 20 against the inner end of the threaded member 22 so that upon rotation of the threaded member 22, the movable plate 20 will be moved toward or away from the end plate 14.

The inner surface of the end plate 14 is provided with a plurality of recesses or cavities 38 which receive the headed end 40 of the pins 42 of a master link 44 which includes a side plate 46 interconnecting the headed ends 40 of the pins 42 which are also received through overlapping side plates 48 and 50 and a roller 52 with the pins 42 being rigidly affixed to the side plate 46 with the headed end 40 of each pin 42 being received in a recess 38 in the end plate 14. The free end of the pins 42 are provided with a groove 54 for receiving a locking spring (not shown) and also receive an assembled side plate 56 having apertures 58 that are dimensioned for press-fitting relationship with the pins 42 thus requiring that the side plate 56 be accurately maintained in alignment with and in perpendicular relationship to the pins 42 so that the apertures 58 will properly press fit onto the pins 42 without the side plate 56 becoming misaligned or tilted in relation to the pins 42 thereby retaining all of the advantages of using a press-fitted relationship.

The movable plate 20 includes a pair of apertures 60 which are in alignment with the recesses 38 and receive the grooved end 54 of the master link pins 42 when the side plate 56 is assembled onto the pins 42 in press-fitted relationship so that upon removal of the assembly device 10 by rotating the screw threaded member 22 in a reverse direction, the conventional retaining spring device for the master link may be engaged with the grooved ends 54 of the pins 42 in a conventional manner.

The bottom edge of the movable plate 20 is disposed adjacent the upper surface of the base plate 12 and the depending lug 28 is received within the slot 30 as illustrated in FIG. 3. The close fitting relationship of the guide rod 34 in the aperture 30 assures accurate positioning of the movable plate 20 in relation to the end plate 14 with the guide rod 34 and spring 36 further assuring accurate positioning and retention of the position of the movable plate 20 during its movement toward the end plate 14.

By using the assembling device or tool of the present invention, presently used roller chains which utilize a master link as a device which unites the free ends of the chain to form a continuous roller drive chain can be more easily, efficiently and effectively assembled into a continuous chain. Until recently, roller chains were assembled by pressing in single pins and peening the end thereof in a manner similar to a rivet head. Recently, roller chains have been constructed in which the master link has a side plate and a pair of pins fixedly attached thereto for insertion through the end rollers of a roller chain to form a continuous chain with the other side plate being positioned over the free ends of the pins and a retaining spring device engaged with the grooved ends of the pins on the master link. It has been found from an engineering standpoint that it is desirable for the assembled side plate to be press fitted onto the pins of the master link rather than the side plate being connected to the pins on the master link by a slip fit. In order to assemble the side plate onto the pins when a press-fit relationship exists, it is necessary to maintain proper alignment and positioning of the side plate while exerting equal assembly pressure throughout the area of the side plate. This is extremely difficult to do by using hand tools which are presently available. The assembly device or tool disclosed herein provides an even distribution of the force pressing the side plate onto the pins in press-fitted relationship and also accurately maintains the side plate in alignment with the pins and in parallel relation to the opposite side plate and perpendicular relation to the pins thus preventing the side plate from being cocked out of square in any direction thereby eliminating any possibility of deforming the master link during assembly of the side plate which would negate the positive structural aspects of the side plate of the master link being press fitted onto the free ends of the pins of the master link.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A device for assembling a master link into a roller drive chain to form an endless chain, said device comprising a base plate, a pair of spaced, parallel, stationary plates supported rigidly from said base plate, a movable plate positioned between said stationary plates and means interconnecting one of such stationary plates and said movable plate to move said movable plate in relation to said stationary plates, the other of said stationary plates having recesses receiving headed ends of the master link pins, said movable plate including a pair of apertures receiving the free ends of the master link pins thereby enabling a side plate to be forced onto the master link pins in a press-fitted relationship, said base plate including a rigid guide rod, said movable plate including an aperture slidably receiving said guide rod in close fitting relation to retain the movable plate in parallel relation to the stationary plates to maintain the side plate to be assembled in perpendicular relation to the master link pins during press-fit assembly onto the pins, a slot in said base plate, said movable plate having a projecting lug received in said slot, said lug having said aperture formed therein and spring means on said guide rod biasing said movable plate in one direction.

2. The structure as defined in claim 1 wherein all of said plates have the same transverse dimension with the inner surface of the movable plate being disposed adjacent the inner surface of the base plate, said aperture in the lug on the movable plate being in close fitting relationship to the guide rod to maintain the movable plate in perpendicular relation to the inner surface of the base plate and in perpendicular relation to the longitudinal axis of the base plate in order to maintain the side plate being assembled on the master link pins in perpendicular relation to the master link pins.

3. The structure as defined in claim 2 wherein said means interconnecting one of said stationary plates and said movable plate includes a screw threaded member screw threaded through the other stationary plate and abutting the movable plate in opposed relation to said one stationary plate whereby rotation of the screw threaded member will move the movable plate towards said one stationary plate and permit spring biased movement of the movable plate away from said one stationary plate.

* * * * *